US005667414A

United States Patent [19]

Karacora

[11] Patent Number: 5,667,414

[45] Date of Patent: Sep. 16, 1997

[54] LOCKABLE FLAT PLUG SLEEVE FOR AN ELECTRICAL CONNECTOR

[75] Inventor: Sami Karacora, Wuppertal, Germany

[73] Assignee: Stocko Metallwarenfabriken Henkels & Sohn GmbH & Co., Wuppertal, Germany

[21] Appl. No.: 536,089

[22] Filed: Sep. 29, 1995

[30] Foreign Application Priority Data

Oct. 6, 1994 [DE] Germany ..... 9416056 U

[51] Int. Cl.[6] ..... H01R 11/22

[52] U.S. Cl. ..... 439/849; 439/397; 439/398

[58] Field of Search ..... 439/268, 398–399, 439/848–850, 397

[56] References Cited

U.S. PATENT DOCUMENTS

| | | | |
|---|---|---|---|
| 4,354,719 | 10/1982 | Weidler | 439/398 |
| 4,934,966 | 6/1990 | D'Urso | 439/849 |
| 5,110,304 | 5/1992 | Kjeldahl | 439/398 |
| 5,139,434 | 8/1992 | Goodman | 439/399 |
| 5,249,980 | 10/1993 | Hatagishi | 439/398 |
| 5,269,699 | 12/1993 | Peloza | 439/849 |
| 5,399,098 | 3/1995 | Marshall et al. | 439/849 |
| 5,525,070 | 6/1996 | Axelsson | 439/849 |

FOREIGN PATENT DOCUMENTS

| | | |
|---|---|---|
| 0024981 | 3/1981 | European Pat. Off. . |
| 0490542 | 6/1992 | European Pat. Off. . |
| 2658030 | 7/1977 | Germany . |
| 3040743 | 5/1982 | Germany . |
| 3929928 | 11/1990 | Germany . |
| 8913961 | 5/1991 | Germany . |
| 9017228 | 6/1992 | Germany . |
| 793562 | 4/1958 | United Kingdom . |
| 1013323 | 12/1965 | United Kingdom . |
| 2217120 | 10/1989 | United Kingdom . |

*Primary Examiner*—David L. Pirlot
*Assistant Examiner*—Brian J. Biggi
*Attorney, Agent, or Firm*—Robert W. Becker & Associates

[57] ABSTRACT

A plug connector for contacting a device, having a plurality of contacts and comprising flat plugs, includes a combination of a lockable flat plug sleeve and an insulation displacement contact.

5 Claims, 4 Drawing Sheets

Fig.5b
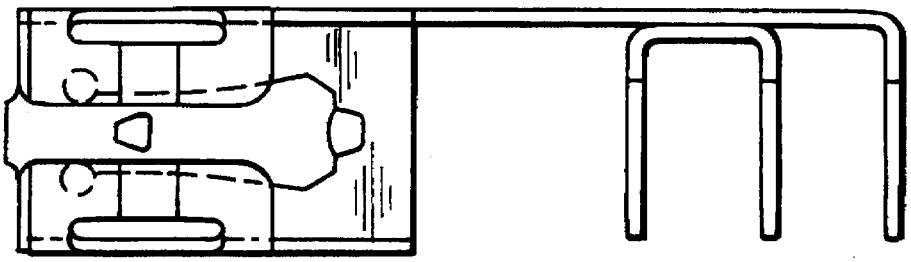
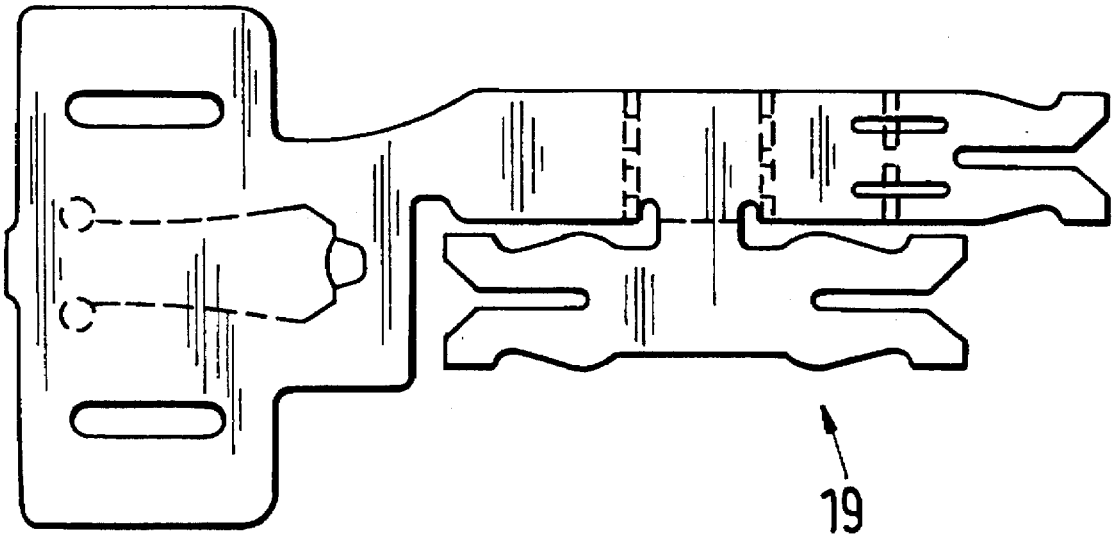
Fig 5a

LOCKABLE FLAT PLUG SLEEVE FOR AN ELECTRICAL CONNECTOR

BACKGROUND OF THE INVENTION

The present invention relates to a plug connector for individually contacting or simultaneously contacting devices provided with flat plugs, which devices have a plurality of contacts, especially control devices such as timers, as used in household appliances with a maximum number of poles of twelve contacts.

A lockable flat plug sleeve is, for example, known from European Patent 0 024 981. It is part of an electrical connection device in which a known flat plug in the form of a rectangular plate is inserted for electrical contacting into a flat plug sleeve and is releasably locked therein. However, it is disadvantageous that the electrical lead is connected with the flat plug sleeve by a crimp connection which thus is provided with a socket suitable for the crimping technique. Employing such a flat plug sleeve thus is impossible where wire harnesses or trees are to be used having electrical contacting elements embodied as insulation displacement contacts.

Electrical contacting elements according to the so-called insulation displacement technique are known from German Patent 39 29 928 for electrical cable plug connections. They are stamped from sheet metal and formed according to the desired shape. For the purpose of contacting, the electrical contacting element is provided with at least one forked spring which between its two legs defines an insertion slot whereby the edges of the two legs facing one another are sharp (i.e., they have a cutting edge). In order to contact the electrical cable, it is inserted into the insertion slot of the forked spring so that the cutting edges of the two forked spring legs cut into the cable insulation. Thereby they come into contact with the electrical lead in order to provide electrical contact. The two forked spring legs exert a clamping force onto the electrical lead so that it is safely held within the insertion slot. When using such a contacting element according to the insulation displacement technique, it is disadvantageous that the spring tongues, between which, for example, the contact pin of a plug of an electrical plug connection is inserted for electrical contacting, is not provided with a locking means. Thus, for securing the electrical connection housings are used which are provided with external locking means which disadvantageously require space and furthermore, due to the risk of breaking off these locking means, do not ensure safe locking.

Accordingly, it is an object of the present invention, to improve a plug connection of the aforementioned kind with which a secure space-saving locking is provided and which allows a partial furnishing as well as a mixed furnishing with insulation displacement contacts and crimp connectors so that all of the connection types which are conventionally used in the industry can be employed in a simple manner.

SUMMARY OF THE INVENTION

A plug connector for contacting a device having a plurality of contacts and comprising flat plugs according to the present invention is primarily characterized by:

A combination of a lockable flat plug sleeve and an insulation displacement contact.

The plug connector also comprises a flat plug. The lockable flat plug sleeve preferably comprises a bottom plate and two upwardly extending sidewalls connected to opposite sides of the bottom plate. Each one of the sidewalls has a free upper edge bent so as to extend toward one another. The bottom plate, the sidewalls, and the free upper edges delimit a compartment for receiving the flat plug. The bottom plate comprises a locking member and the flat plug comprises a cutout. The locking member engages the cutout for locking the flat plug in the flat plug sleeve upon insertion of the flat plug into the flat plug sleeve. The flat plug sleeve has a release device for releasing the locking member from engagement with the cutout.

Advantageously, one of the sidewalls has an elongated end projecting past the bottom plate. The elongated end is bent so as to form a free end extending at a right angle to the sidewall. The free end is the insulation displacement contact having a forked spring with an insertion slot.

In a preferred embodiment of the present invention a plurality of forked springs are provided so as to extend coaxially to the flat plug sleeve.

Advantageously, the elongated end is bent multiple times at a right angle to form a meander structure and the forked springs are provided at portions of the meander structure extending at a right angle to the sidewall.

In another embodiment of the present invention, the elongated end comprises a bending member bent such that portions of the bending member extend at a right angle to the sidewall.

In yet another embodiment of the present invention the plug connection preferably further comprises a crimp connector.

According to the present invention, the plug connector of the aforementioned kind is improved by providing a combination of a lockable flat plug sleeve with an insulation displacement contact. This ensures that a safe inner locking is possible so that housings without external locking arms can be used. This results in a considerable saving of space. Furthermore, the inventively suggested insulation displacement contact allows for the employment of known pick-and-place machines for simultaneous placement and furnishing whereby electrical connections which, due to machine-technological reasons, cannot be embodied in the insulation displacement technique can be subsequently applied with crimp connectors according to a further expedient embodiment of the invention. This allows for the manufacture of any desired cable and wire harness with different connecting types within one device (appliance). The inventive plug connector fits into housings which have spacings of 5 mm whereby in these housings external locking arms as provided in the prior art, are obsolete because locking is achieved by locking the flat plug within the flat plug sleeve.

According to a further expedient embodiment of the invention the lockable flat plug sleeve is provided with a compartment for the flat plug which compartment is comprised of a bottom plate with two sidewalls having free edges which, above the bottom plate, are inwardly bent. The plug connector is provided with a locking device comprised of a locking member provided at the bottom plate and a cutout provided at the flat plug. The locking member engages the cutout and locks plug and sleeve, but is releasable from the cutout with a release device. Such a flat plug sleeve has the advantage that only a small force for the insertion is required, that due to the locking action a secure contacting is ensured, and that despite the secure locking a desired separation of plug and sleeve is possible any time.

For embodying the insulation displacement contact it is advantageously suggested to extend one of the sidewalls so as to provide an elongated end projecting past the bottom plate and to bend the elongated end at a right angle. The bent portion (free end) is provided with a forked spring with insertion slot in a manner known per se. It is possible to provide a plurality of forked springs in series so as to be coaxially positioned relative to the flat plug sleeve. With respect to space considerations it is expedient to form the forked springs by providing meander structure at the elongated end of the sidewall and/or by providing bending members at the elongated end of the sidewall.

According to a further advantageous embodiment, in addition to the one or more contacts in insulation displacement technique, a crimp connector can be provided.

BRIEF DESCRIPTION OF THE DRAWINGS

The object and advantages of the present invention will appear more clearly from the following specification in conjunction with the accompanying drawings, in which:

FIG. 5*a* shows a stamped sheet metal piece as a blank for manufacturing the plug connector of FIG. 4;

FIG. 5*b* shows in a top view the plug connector folded from the blank of FIG. 5*a.

DESCRIPTION OF PREFERRED EMBODIMENTS

Figures 1, 2, 3, 6:
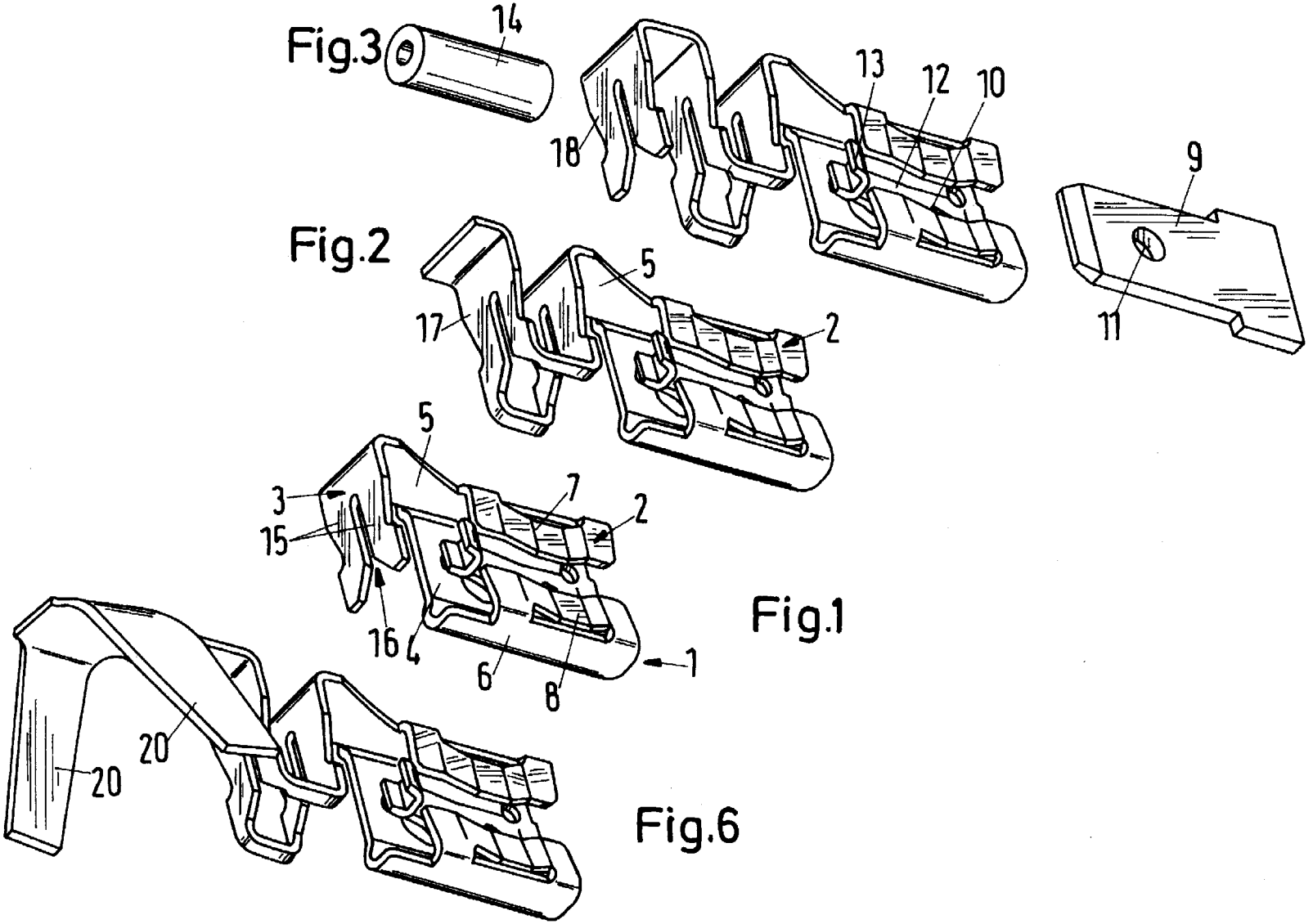
FIG. 1 shows a plug connector in a perspective representation with one insulation displacement contact.
FIG. 2 shows a plug connector in a perspective representation with two insulation displacement contacts.
FIG. 3 shows a plug connector in a perspective representation with three insulation displacement contacts, schematically indicating the position of an electric cable and a flat plug.
* and FIG. 6 shows the plug connector of FIG. 2 with an additional crimp connector.

The plug connector 1 represented in the drawing is a combination of a lockable flat plug sleeve 2 with an insulation displacement contact 3. As a preferred material a copper-tin alloy is used whereby the contact surfaces of the plug connector are coated with tin. The manufacture is carried out such that from a strip of sheet metal by stamping, bending, and forming, a plug connector according to FIG. 4 of the drawing is produced. A develop projection according to FIG. 5*a* of the drawing illustrates which machining steps are required.

The lockable flat plug sleeve 2 comprises a bottom plate 4 with two sidewalls 5 and 6 which are essentially perpendicularly upwardly bent and the two free edges 7, 8 of which are inwardly bent in order to provide a box-shaped compartment for a flat plug 9. In order to ensure a sliding insertion requiring little insertion force, the free edges 7, 8 are provided with a slight indentation so that a slightly curved contour results. Any play between the flat plug 9 within the compartment delimited by the bottom plate 4, the two sidewalls 5 and 6 as well as the free edges 7 and 8 is to be avoided. By providing the indentation at the free edges 7, 8 a good contact between the flat plug sleeve 2 and the flat plug 9 is ensured.

The locking device of the plug connector is as follows: The bottom plate 4 is provided with a locking member 10 which cooperates with a cutout 11 of the flat plug 9 so as to provide a locking clamp arrangement. In order to provide for a releasable locking, a U-shaped cutout 12 is provided at the bottom plate 4 the free end of which is bent upwardly and thus forms a release device 13 acting on the locking member 10. By applying pressure on the release device 13, the tongue formed by the U-shaped cutout 12 can be elastically pushed downwardly so that the locking member 10 no longer engages the cutout 11 of the flat plug 9 and the locking device is released.

The sidewall 5 of the flat plug sleeve 2 in the drawing is extended to the left with an elongated end that is bent at a right angle inwardly. In order to be able to contact an electrical cable 14 at this bent portion (free end) by insulation displacement technique, the bent portion (free end) is provided with a forked spring 15 having legs between which an insertion slot 16 for the electrical cable 14 is defined.

For contacting the electrical cable 14, in the position illustrated in the drawing, cable 14 is inserted from the bottom into the insertion slot 16. The sharpened edges (cutting edges) of the two legs of the forked spring facing one another cut into the insulation of the electric cable 14 and down to the wire (lead) to thereby produce electric contact.

The embodiments represented in FIGS. 2 and 3 of the inventive plug connection have multiple insulation displacement contacts as compared to the embodiment of FIG. 1. In the embodiment according to FIG. 2 the aforementioned elongated end of the sidewall 5 of the flat plug sleeve 2 is bent to form a meander structure so that an additional forked spring 17 as a second insulation displacement contact is provided by correspondingly stamping the sheet metal material. Correspondingly, in the embodiment according to FIG. 3 the meander structure of the elongated end of the sidewall is extended and provides for a third insulation displacement contact 18.

Figure 4:
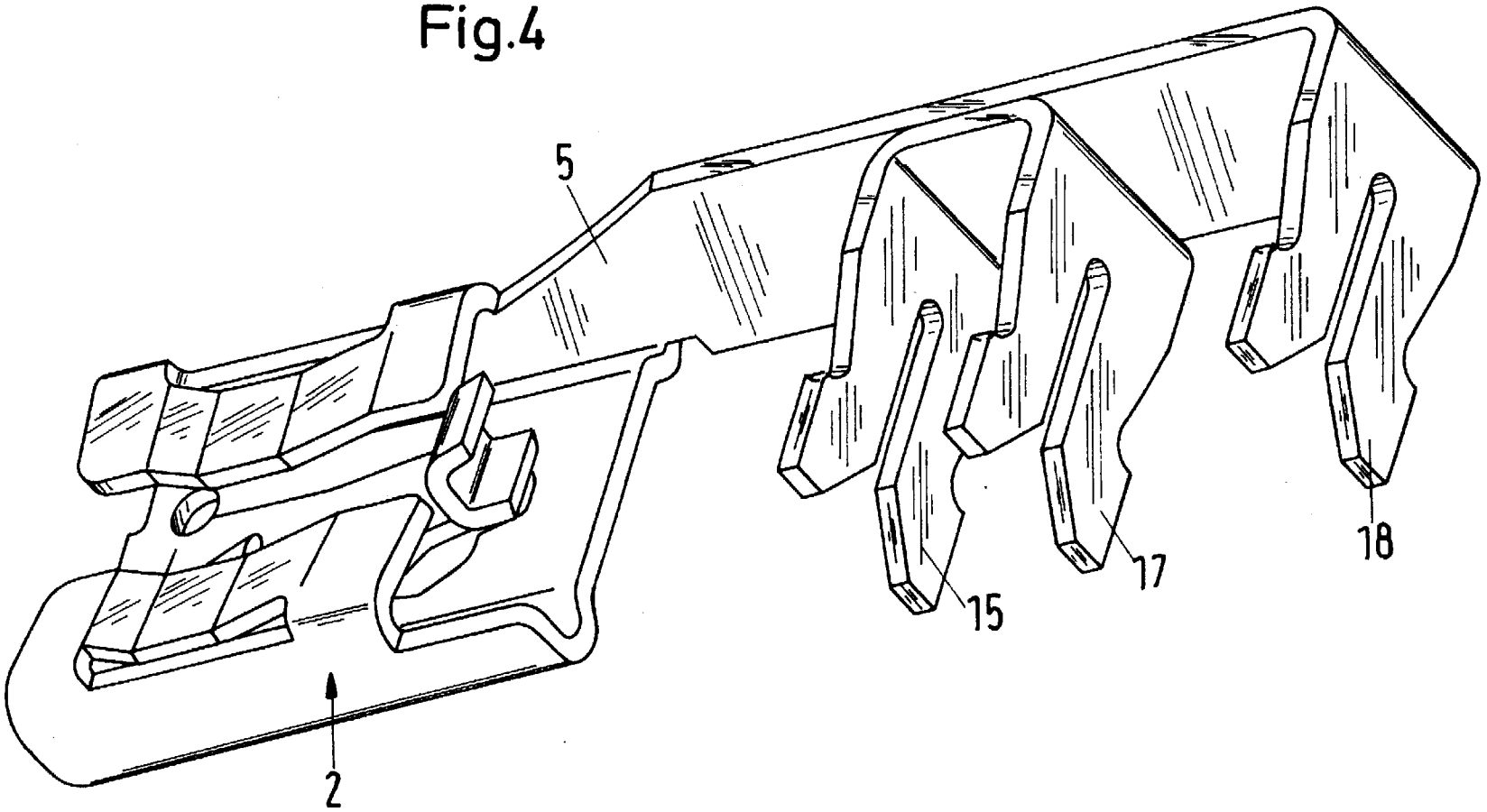
FIG. 4 shows in another embodiment a plug connector with three insulation displacement contacts.
Figure 7:
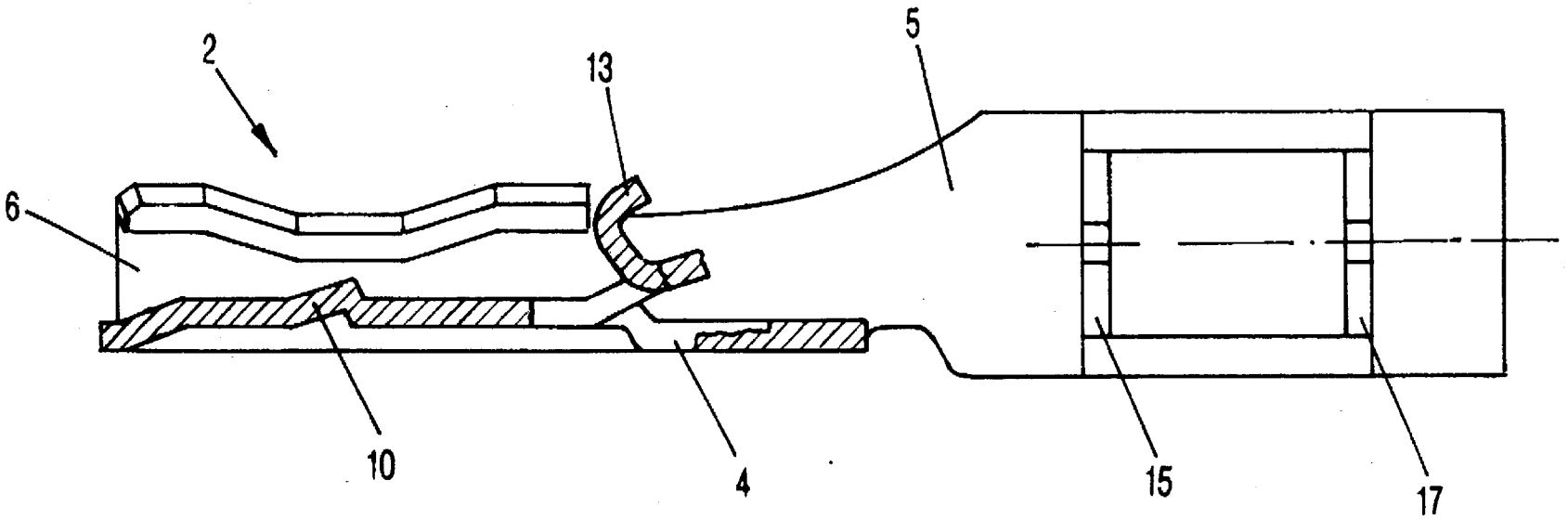
FIG. 7 shows a plug connector in a sectional representation with the locking member and the lock release.

Instead of the aforedescribed manufacture of the insulation displacement contacts by bending the elongated end of the sidewall to a meander structure, it is possible, as shown in the embodiments of FIGS. 4 and 5, to provide an elongated end of the sidewall 13 such that the forked spring 15 as a first insulation displacement contact and the forked spring 17 as a second insulation displacement contact are made from a pre-stamped bending member 19, while the third insulation displacement contact 18, as in the previous embodiments, is formed by bending the elongated part of the extended sidewall 5 of the flat plug sleeve 2 at a right angle. By providing the stamped bending member a greater stability and safety against bending of the elongated end during contacting with the cable is achieved.

In the embodiment represented in FIG. 6 an additional crimp connector 20 is provided arranged in series with the insulation displacement contacts at the flat plug sleeve 2.

The present invention is, of course, in no way restricted to the specific disclosure of the specification and drawings, but also encompasses any modifications within the scope of the appended claims.

What I claim is:

1. A plug connector for contacting a device having a plurality of contacts and comprising flat plugs; said plug connector comprising:

a combination of a lockable flat plug sleeve and an insulation displacement contact;

a flat plug;

said lockable flat plug sleeve comprising a bottom plate and two upwardly extending sidewalls connected to opposite sides of said bottom plate and having a longitudinal extension parallel to said opposite sides of said bottom plate;

each one of said sidewalls having a free upper edge bent so as to extend toward one another;

said bottom plate, said sidewalls, and said free upper edges delimiting a compartment for receiving said flat plug;

said bottom plate comprising a locking member and said flat plug comprising a cutout;

said locking member engaging said cutout for locking said flat plug in said flat plug sleeve upon insertion of said flat plug into said flat plug sleeve;

said flat plug sleeve having a release device for releasing said locking member from engagement with said cutout;

one of said sidewalls having an elongated end projecting past said bottom plate in a direction of said longitudinal extension;

said elongated end being bent so as to have a free end extending at a right angle to said sidewall, wherein said free end is said insulation displacement contact and has a forked spring with an insertion slot.

2. A plug connector according to claim 1, wherein a plurality of forked springs are provided so as to extend coaxially to said flat plug sleeve.

3. A plug connector according to claim 2, wherein said elongated end is bent multiple times at a right angle to form a meander structure and wherein said forked springs are provided at portions of said meander structure extending at a right angle to said sidewall.

4. A plug connector according to claim 2, wherein said elongated end comprises a bending member bent such that portions of said bending member extend at a right angle to said sidewall and are provided with said forked springs.

5. A plug connector according to claim 1, further comprising a crimp connector.

* * * * *